US008285159B2

(12) United States Patent
Ueda et al.

(10) Patent No.: US 8,285,159 B2
(45) Date of Patent: Oct. 9, 2012

(54) COLOR IMAGE FORMING APPARATUS WITH EXPOSURE TIMING CONTROL BASED ON PRINTING RATIO

(75) Inventors: Tadayuki Ueda, Kokubunji (JP); Akifumi Isobe, Hidaka (JP); Yoshihito Sasamoto, Hachioji (JP); Takashi Nara, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 465 days.

(21) Appl. No.: 12/482,666

(22) Filed: Jun. 11, 2009

(65) Prior Publication Data

US 2009/0317147 A1 Dec. 24, 2009

(30) Foreign Application Priority Data

Jun. 23, 2008 (JP) ..... 2008-162637

(51) Int. Cl.
*G03G 15/043* (2006.01)

(52) U.S. Cl. ..... 399/52

(58) Field of Classification Search ..... 399/51, 399/52, 301

See application file for complete search history.

(56) References Cited

U.S. PATENT DOCUMENTS 5,444,525 A * 8/1995 Takahashi et al. ..... 399/76
2007/0120939 A1* 5/2007 Arai et al. ..... 347/132

FOREIGN PATENT DOCUMENTS

JP 7-225544 A 8/1995
JP 2000-356875 A 12/2000
JP 2004-191600 A 7/2004
JP 2006-154072 6/2006
JP 2008-126566 6/2008

OTHER PUBLICATIONS

Office Action issued by the Japanese Patent Office on May 22, 2012 in corresponding Japanese Patent Application No. 2008-162637, and English translation thereof.

* cited by examiner

*Primary Examiner* — Walter L Lindsay, Jr.
*Assistant Examiner* — Billy J Lactaoen
(74) *Attorney, Agent, or Firm* — Buchanan Ingersoll & Rooney PC

(57) ABSTRACT

A color image forming apparatus for forming toner images by carrying out charging, exposure, and development on at least one photoreceptor drum, and forming color images by transferring the toner images onto sheets, the color image forming apparatus including: a photoreceptor drum which rotates around an axis; an exposure section which intermittently emits a light beam onto the cylindrical surface of the rotating photoreceptor drum along scanning lines parallel to the axis of the photoreceptor drum; a calculation section which calculates a printing ratio of a color image to be formed on one sheet, wherein the printing ratio is the ratio of the area covered by toner in the color image; and a timing control section which controls a timing when the exposure section emits the light beam in a direction of rotation of the photoreceptor drum based on the printing ratio calculated by the calculation section.

13 Claims, 6 Drawing Sheets

COLOR IMAGE FORMING APPARATUS WITH EXPOSURE TIMING CONTROL BASED ON PRINTING RATIO

CROSS REFERENCE TO RELATED APPLICATION

The present application is based on Japanese Patent Application No. 2008-162637 filed with Japanese Patent Office on Jun. 23, 2008, the entire content of which is hereby incorporated by reference.

BACKGROUND OF THE INVENTION

1. Technical Field

The present invention relates to color image forming apparatuses which form color images on sheets by transferring toner images formed on photoreceptor drums on to a transfer member.

2. Description of Prior Art

Color image forming apparatuses such as copying machines, printers, facsimiles, etc., that use the electro-photography method, form images on sheets using, for example, a procedure such as the following. To begin with, an electrostatic latent image is formed by exposing a charged photoreceptor drum to light, and then a toner image is formed by making the electrostatic latent image visible by applying toner to the photoreceptor drum. Next, by transferring and fixing this toner image onto a sheet via a transfer member, a color image is formed on the sheet. As a means for exposure of the photoreceptor drum, apart from one that scans a laser beam along the main scanning direction, an LED print head that has a plurality of light emitting diodes arranged along the main scanning direction has been known conventionally.

A color image is formed, according to the above procedure, for example, by forming toner images of each color of yellow, magenta, cyan, and black, and by superimposing these one upon the other. If the position of superimposing each of the toner images gets shifted due to variations in the speed of rotation of the photoreceptor drum, a color shift (or color registration error) will occur in the color image formed on the sheet, and the image quality decreases.

In view of this, an image forming apparatus has been proposed that is provided with a rotation detection section which obtains the amount of movements in the rotation of the photoreceptor drum which is the image recording medium, and a recording timing control section that controls the recording timing for starting the recording of the image in a direction intersecting the rotation movement direction according to the amount of rotation movement obtained from the rotation detection section (see, for example, Unexamined Japanese Patent Application Publication No. Hei07-225544).

In paragraph 0036 of Unexamined Japanese Patent Application Publication No. Hei07-225544, it has been described that, even when any fluctuations are present in the rotational speed of the photoreceptor drum, it is possible to control the recording timing of starting the formation of the image in the main scanning direction of the photoreceptor drum so that the images transferred to the image transfer medium are at equal intervals in the direction of movement of rotation of the photoreceptor drum, and as a result of this, it is possible to eliminate density striations or image shifts.

Further, in Unexamined Japanese Patent Application Publication No. 2000-356875, an image forming apparatus has been proposed which controls the timing of starting the formation of images on the photoreceptor drum based on the timing of starting the conveying of transfer material.

Further, in Unexamined Japanese Patent Application Publication No. 2004-191600, an image forming apparatus has been proposed which corrects the shift in registration in the sub scanning direction that changes successively along with the rotation of the photoreceptor drum which is the image supporting member by converting the image data.

However, in any of the control methods of the above patent documents, the printing ratio of the color image formed on the sheet has not been taken into consideration for suppressing the color shift of the color image that is caused by the variation component of the photoreceptor drum. Therefore, since the angular speed of the photoreceptor drum varies according to the printing ratio of the color image, it is not possible to suppress the color shift in a direction perpendicular to the axis of the photoreceptor drum that is caused by the variation component of the photoreceptor drum in accordance with the printing ratio.

SUMMARY

An image forming apparatus reflecting one aspect the present invention for solving the above problems, is A color image forming apparatus for forming toner images by carrying out charging, exposure, and development on at least one photoreceptor drum, and forming color images by transferring the toner images onto sheets, the color image forming apparatus including:

a photoreceptor drum which rotates around an axis;

an exposure section which intermittently emits a light beam onto the cylindrical surface of the rotating photoreceptor drum along scanning lines parallel to the axis of the photoreceptor drum;

a calculation section which calculates a printing ratio of a color image to be formed on one sheet, wherein, the printing ratio is the ratio of the area covered by toner in the color image; and a timing control section which controls a timing when the exposure section emits the light beam in a direction of rotation of the photoreceptor drum based on the printing ratio calculated by the calculation section.

BRIEF DESCRIPTION OF THE DRAWINGS

These and other objects, advantages and features of the invention will become apparent from the following description thereof taken in conjunction with the accompanying drawings in which:

FIG. 5 shows graphs that show the relationship between the angle of rotation of the photoreceptor drum 1Y and the correction amount of the timing at which the exposure section 3Y emits light, wherein

DETAILED DESCRIPTION OF THE PREFERRED EMBODIMENTS

Figure 1:
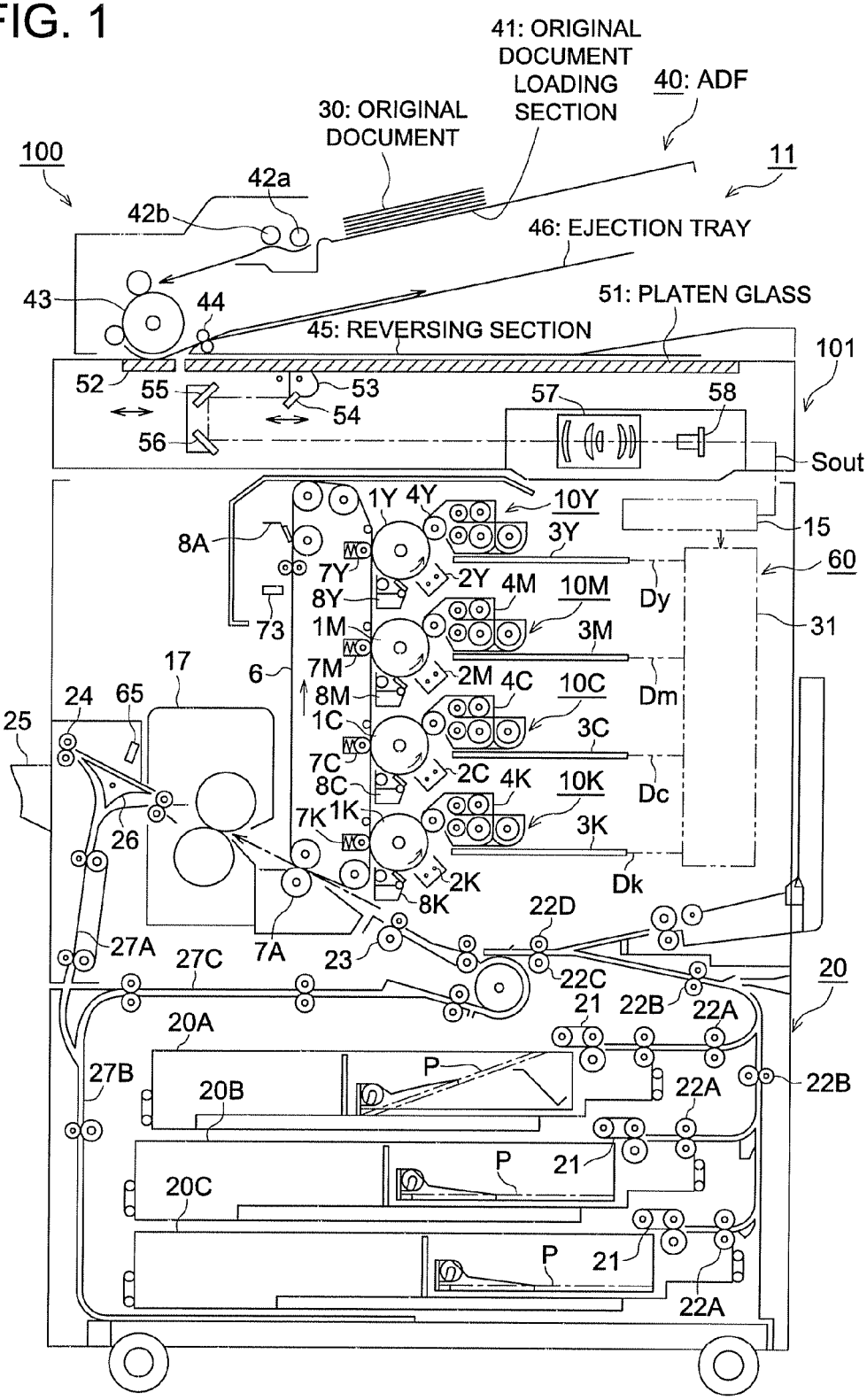
FIG. 1 is a front view diagram showing an outline of the internal configuration of a color copying machine 100 according to a preferred embodiment of the present invention.

In the following, some preferred embodiments of the present invention are explained referring to the drawings. In the drawings, identical parts are assigned the same symbols and their explanations have been omitted.

Firstly, referring to FIG. 1, an outline of the internal configuration of a color copying machine 100 according to a preferred embodiment of the present invention is explained. The color copying machine 100 is an example of a color image forming apparatus, which is an apparatus that obtains the image information by reading out the color images formed on the original document 30, after forming images of different colors on the photoreceptor drums based on this image information, forms images on a sheet on which the different color images are superimposed. A color image forming apparatus according to the present invention, can also be applied to, apart from a color copying machine 100, a color printer or color facsimile machine, or to a unit that is a combination of these.

The color copying machine 100 has a copying machine main unit 101. An image input section 11 and an ADF 40 are provided on the top part of the copying machine main unit 101. Here, "ADF" is an abbreviation for "Automatic original Document Feeder" unit. During the ADF mode, the ADF 40 operates so as to automatically supply one or a plurality of sheets of the original document 30. Here, "ADF mode" is an abbreviation for "Automatic original Document Feeding mode" in which the operation is made of automatically feeding the original document 30 placed on the ADF 40 and of reading out the original document images automatically.

The ADF 40 has an original document loading section 41, roller 42*a*, roller 42*b*, roller 43, conveying rollers 44, and sheet discharge tray 46. One or a plurality of sheets of an original document is placed on the original document loading section 41. Roller 42*a* and roller 42*b* are provided on the downstream side of the original document loading section 41. When the ADF mode is selected, the original document 30 fed out from the original document loading section 41 is conveyed so that it is rotated in the form of the letter U by the downstream side roller 43. Further, when the ADF mode is selected, the original document 30 is placed on the original document loading section 41 so that its recording surface is facing up.

Further, the image input section 11 operates so as to read out the color images formed on the original document 30. For the image input section 11, for example, a slit scan type scanner for color is used. The image input section 11 is provided with an array shaped image sensor 58, and, for example, in the ADF mode, when the original document 30 is being inverted in the shape of the letter U by the roller 43, the front surface of that document 30 is read out and the image read out signal Sout is output. For the image sensor 58, for example, a photographing device made of 3-line color CCDs is used. Here, "CCD" is an abbreviation for "Charge Coupled Device".

The image sensor 58 is provided with three read out sensors for detecting lights of the red color, green color, and blue color and which are configured by arranging a plurality of rows of light receiving devices along the main scanning direction, and the three read out sensors divide the pixels at different positions along the sub scanning direction which is at right angles to the main scanning direction, and reads out the light information simultaneously for the colors red, green, and blue.

The original document 30 read out by the image input section 11 is conveyed by the conveying rollers 44 and is discharged to the sheet discharge tray 46. Further, the image sensor 58, during the platen mode, is made to output the image read out signal of the RGB color system that has been obtained by reading out the original document 30. Here, the "platen mode" refers to the operation of automatically reading out the original document image by scanning the optical drive system with respect to the original document 30 placed on the platen glass.

The image input section 11 has, apart from the image sensor 58, a first platen glass 51, a second platen glass 52, a light source 53, a mirror 54, a mirror 55, a mirror 56, a focusing optical section 57, and an optical drive section that is not particularly shown in the figure. Here, the ADF glass is included in the second platen glass 52. The light source 53 emits light on to the original document 30. The optical drive section operates so as to move the original document or the image sensor 58 relatively in the sub scanning direction. The sub scanning direction, when the direction of arrangement of the plurality of light receiving devices constituting the image sensor 58 is taken as the main scanning direction, is a direction at right angles to this main scanning direction. The mirrors 54 to 56 are placed so as to bend back the light reflected by the original document 30, and the focusing optical section 57 focuses the bent back light on to the image sensor 58. In this manner, an original document 30 placed on the original document loading section 41 is conveyed by the rollers 42*a*, 42*b*, 43, and by the conveying rollers 44 described above, the image on one side or on both sides of the original document 30 is scanned and exposed by the optical system of the image input section 11 that includes the light source 53, the mirrors 54, 55, and 56, the focusing optical section 57, and the optical drive section, and the reflected light representing the image information of the original document 30 is read out by the image sensor 58.

The image sensor 58 carries out photoelectric conversion of the amount of light in the incident light into an electric charge. The photoelectric converted analog image read out signal is A/D converted inside the image input section 11 and the digital image read out signal Sout is output from the image input section 11. An image processing section 31 is connected to the image input section 11 via the control section 15. The image processing section 31 carries out image compression processing and magnification variation processing on the digital image read out signal Sout, and converts it into image data of the different components of the red color, green color, and blue color. In addition, the image processing section 31 uses the three dimensional color information conversion table to convert the image data of the three components of the red color, green color, and blue color, into the image data Dy, Dm, Dc, and Dk for the colors of yellow, magenta, cyan, and black. The converted image data Dy, Dm, Dc, and Dk are transferred respectively to the exposure sections 3Y, 3M, 3C, and 3K that configure the image forming section 60.

The copying machine main unit 101 is one that is called a tandem type color image forming apparatus. An image forming section 60 is provided in the copying machine main unit 101. The image forming section 60 forms color images based on the image data Dy, Dm, Dc, and Dk obtained by the reading out operation by the image input section 11. The image forming section 60 has a plurality of image forming units 10Y, 10M, 10C, and 10K that have photoreceptor drums for each of the colors of yellow, magenta, cyan, and black, an endless shaped intermediate image transfer member 6, and a fixing unit 17 for fixing the toner image transferred to the sheet from the intermediate image transfer member 6.

The image forming unit 10Y that forms images of the yellow color is provided with a photoreceptor drum 1Y for forming yellow color toner images, and a charging section 2Y for yellow color, an exposure section 3Y, a development section 4Y, and a cleaning section 8Y for the image formation member, all placed in the periphery of the photoreceptor drum 1Y. The image forming unit 10M that forms images of the magenta color is provided with a photoreceptor drum 1M for forming magenta color toner images, and a charging section 2M for magenta color, an exposure section 3M, a development section 4M, and a cleaning section 8M for the image formation member, all placed in the periphery of the photoreceptor drum 1M.

The image forming unit 10C that forms images of the cyan color is provided with a photoreceptor drum 1C for forming cyan color toner images, and a charging section 2C for cyan color, an exposure section 3C, a development section 4C, and a cleaning section 8C for the image formation member, all placed in the periphery of the photoreceptor drum 1C. The image forming unit 10K that forms images of the black color is provided with a photoreceptor drum 1K for forming black color toner images, and a charging section 2K for black color, an exposure section 3K, a development section 4K, and a cleaning section 8K for the image formation member, all placed in the periphery of the photoreceptor drum 1K.

The photoreceptor drums 1Y, 1M, 1C, and 1K are cylindrical members that rotate around prescribed axes that are at right angles to the direction the sheet on which a color image is formed is conveyed. The charging sections 2Y, 2M, 2C, and 2K charge the cylindrical surfaces of the photoreceptor drums 1Y, 1M, 1C, and 1K by uniformly supplying electrical charge continuously to the cylindrical surfaces of the rotating photoreceptor drums 1Y, 1M, 1C, and 1K.

The exposure sections 3Y, 3M, 3C, and 3K are provided with a plurality of optical modulation devices that are arranged in the shapes of lines along the main scanning direction which is parallel to said prescribed axes. For example, as the exposure sections 3Y, 3M, 3C, and 3K, it is possible to use an LPH in which LED devices are used as the optical modulation devices. Here, "LPH" is an abbreviation for "LED Printer Head". Each optical modulation device emits light towards the cylindrical surfaces of the photoreceptor drums 1Y, 1M, 1C, and 1K. The exposure sections 3Y, 3M, 3C, and 3K, based on the image data Dy, Dm, Dc, and Dk, modulate the light emitted to the cylindrical surfaces of the rotating photoreceptor drums 1Y, 1M, 1C, and 1K. In this manner, by intermittently emitting light beams onto the cylindrical surface of the rotating photoreceptor drum along scanning lines parallel to the axes of the photoreceptor drums 1Y, 1M, 1C, and 1K, an electrostatic latent image is formed on each of the photoreceptor drums 1Y, 1M, 1C, and 1K. This is called "exposure". Further, the direction of conveying the sheet is referred to as the "sub scanning direction".

The development sections 4Y, 4M, 4C, and 4K, develop the electrostatic latent images on the photoreceptor drums 1Y, 1M, 1C, and 1K, and form toner images of the yellow color, magenta color, cyan color, and black color, respectively. This is called "development". The development by the development sections 4Y, 4M, 4C, and 4K is carried out by reversal development by applying a development bias in which an AC voltage is superimposed on a DC voltage with the same polarity as the toner polarity used, for example, negative polarity.

The intermediate transfer member 6 is supported in a free to rotate manner by a plurality of rollers. The primary transfer rollers 7Y, 7M, 7C, and 7K are placed at positions opposite the photoreceptor drums 1Y, 1M, 1C, and 1K, with the intermediate transfer member 6 positioned in between. By applying the primary transfer bias of a polarity opposite to the polarity of the toner used, for example, positive polarity, to the primary transfer rollers 7Y, 7M, 7C, and 7K, the respective toner images of the yellow color, magenta color, cyan color, and black color, respectively, that are formed on each of the photoreceptor drums 1Y, 1M, 1C, and 1K are successively transferred on to the rotating intermediate transfer member 6 in a superimposing manner. In this manner, a color toner image is formed on the intermediate transfer member 6 in which the respective toner images of the yellow color, magenta color, cyan color, and black color are superimposed on each other. This is called "primary transfer".

Further, in the lower part of the image forming section 60, a conveying section 20 is provided that operates so as to convey sheets P to the image forming section 60, and the conveying section 20 has sheet feeding trays 20A, 20B, and 20C that store sheets P. The sheets P stored in the sheet feeding trays 20A, etc., are fed out by the sheet issuing roller 21 and the sheet feeding roller 22A provided in the sheet feeding tray 20A, etc., are passed through the conveying rollers 22B, 22C, and 22D, and the registration roller 23, etc., conveyed to the secondary transfer roller 7A, and on one surface of the sheet P, for example, on the front surface, the color toner image is transferred at once from the intermediate transfer member 6 to the sheet P. This is called "secondary transfer".

The fixing unit 17 fixes the color toner on to the sheet P by applying heat and pressure to the sheet P on to which a color toner image has been transferred. This is called a "fixing operation". The sheet P after the fixing operation is gripped by sheet discharge rollers 24 and is placed on the sheet discharge tray 25 that is outside the machine. The residual toner remaining on the outer peripheral surfaces of the photoreceptor drums 1Y, 1M, 1C, and 1K after transferring is removed by the cleaning sections 8Y, 8M, 8C, and 8K, and the operation moves on to the next color image formation cycle.

When forming images on both sides of the sheet P, after forming images on the front surface, the sheet P discharged from the fixing unit 17 is branched from the sheet discharge path by the branching section 26. Next, the sheet P is passed through the re-circulating sheet path 27A on the lower side, turned upside down by the inverting and conveying path 27B which is the sheet re-feeding mechanism, passed through the sheet re-feeding conveying section 27C, and is joined to the transfer path described earlier from the conveying roller 22D onwards.

The inverted and conveyed sheet P is passed through the registration roller 23, conveyed again to the secondary transfer roller 7A, and a color toner image is transferred at once on to the back surface of the sheet P. On the other hand, after the color toner image is transferred on to the sheet P by the secondary transfer roller 7A, the residual toner remaining on the intermediate transfer member 6 after the sheet P is separated from it by bending is removed by the cleaning section 8A for the intermediate transfer member.

Although not shown in FIG. 1, the color copying machine 100 is provided with, apart from the copying machine main unit 101, a finishing apparatus and a large capacity sheet feeding apparatus that are placed next to the copying machine main unit 101. The finishing apparatus carries out operations such as large capacity stacking, sorting, stapling, punching, folding, cover sheet insertion, simple binding, trimming, etc., and the large capacity sheet feeding apparatus can supply large quantities of sheets.

Figure 2:
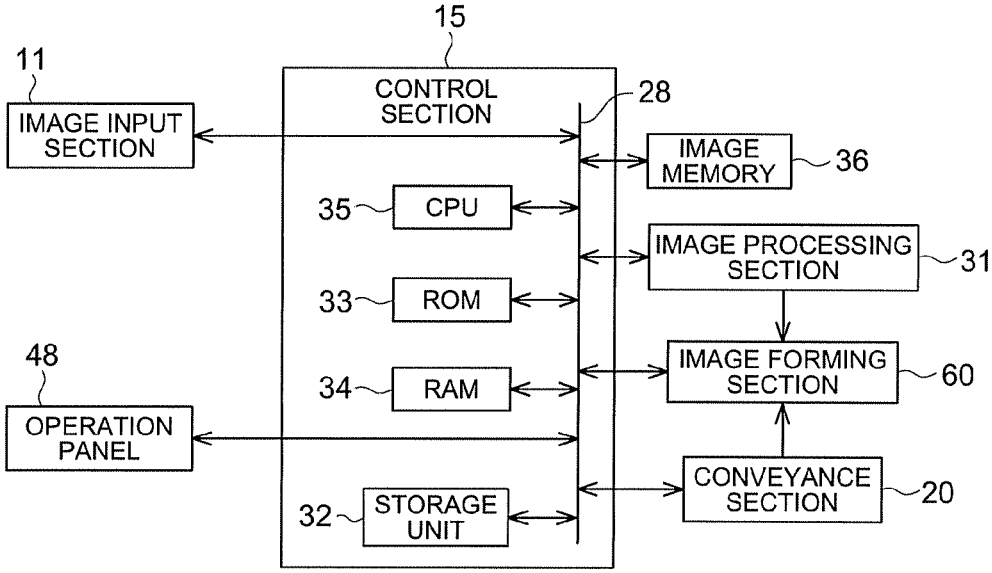
FIG. 2 is a block diagram showing the control configuration of the color copying machine 100 of FIG. 1.

Next, referring to FIG. 2, the control configuration of the color copying machine 100 of FIG. 1 is explained here. The color copying machine 100 has an image input section 11, a control section 15, a conveying section 20, an image processing section 31, an image memory 36, an operation panel 48, and an image forming section 60.

The control section 15 has a ROM 33, a CPU 35, a RAM 34 that provides the data storage area for working, a storage unit 32, and a bus 28. Here, ROM is an abbreviation for Read Only Memory, CPU is an abbreviation for Central Processing Unit, and RAM is an abbreviation for Random Access Memory that denotes a storage apparatus to and from which it is possible to write or read data at any time.

The ROM 33 stores not only system program data for controlling the entire color copying machine 100, but also stores program data than can be executed by the control section 15. When the power supply to the color copying machine is switched ON, the CPU 35 initiates the system after reading out the system program data from the ROM 33, and controls the entire color copying machine 100. The bus 28 is connected to the ROM 33, CPU 35, RAM 34, and the storage unit 32, and constitutes the control bus and the data bus that are the transmission paths for the different types of control signals and data signals.

The operation panel 48 is, for example, a touch panel connected to the bus 28 and which is a display monitor such as a liquid crystal display device (LCD), etc., which is combined with a matrix switch. Further, the operation panel 48 also has the function of a display section that displays the operation screens of the color copying machine 100, and the functions of a setting section that accepts the inputs of various settings by the operator who carries out the operations of pressing the matrix switches. For example, the operation panel 48 displays the different operation screens for the settings, etc., of the type of paper of sheets P used for image forming by the image forming section 60 or the image forming conditions such as single sided or double sided image forming, selection of the sheet feeding cassette, setting or output image density, selection of sheet size, setting of number of copies, etc., and accepts the inputs of the different settings.

The image input section 11 is connected to the bus 28. Further, the image input section 11 is provided with an analog to digital converter that is not shown in the figure. This analog to digital converter A/D converts the analog image read out signal obtained by photoelectric conversion by the image sensor 58 and outputs the digital image read out signal Sout to the image processing section 31.

The image processing section 31 is connected to the bus 28. Further, the image processing section 31 is provided with a DSP, a RAM, etc., and converts the A/D converted digital image read out signal Sout into image data of the different components of the colors red, green, and blue. The converted image data of each of the components of the colors red, green, and blue are stored in an image memory 36 that is made of a hard disk or a semiconductor memory, etc. Further, "DSP" is an abbreviation for Digital Signal Processor.

Further, the image processing section 31 reads out the image data of the different components of the colors of red, green, and blue from the image memory 36 and converts them into image data Dy, Dm, Dc, and Dk for the yellow color, magenta color, cyan color, and black color, and outputs to the image forming section 60. Among the image forming section 60, for example, the exposure section of the yellow color, according to the input of the image data Dy for the yellow color, forms the electrostatic latent image for the color yellow on the photoreceptor drum 1Y.

The conveying section 20 is connected to the bus 28. Further, the conveying section 20 selects one of the sheet feeding trays 20A, 20B, and 20C, and conveys the sheet P issued from the sheet feeding tray 20A, 20B, or 20C to the image forming section 60. The image forming section 60 executes the sequence of image forming processes explained referring to FIG. 1, and forms a color image on the sheet P. The sequence of image forming processes includes the processes of charging, exposure, development, primary transfer, secondary transfer, and fixing.

Figure 3A:
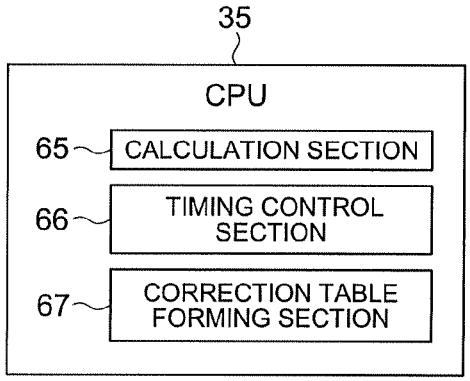
FIG. 3*a* is a block diagram showing the concrete functions carried out by the CPU 35 of FIG. 2.

Referring to FIG. 3*a*, the concrete functions carried out by the CPU 35 of FIG. 2 are explained here. The CPU 35 functions as a calculation section 65, a timing control section 66, and a correction table forming section 67 according to the program executed due to the system program data read out from the ROM 33.

The calculation section 65 calculates the printing ratio of the color image formed on one sheet P. The printing ratio is calculated based on the image data of the original document 30 that is read out by the image input section 11. In the "image data of the original document 30 that is read out by the image input section 11" are included the digital image read out data Sout that is A/D converted in the image input section 11, the red color, green color, and blue color component image data that are converted by the image processing section 31, and the image data Dy, Dm, Dc, and Dk that are color converted by the image processing section 31.

Here, the "printing ratio" (Printing Ratio or Ratio of Printing Area) includes the printing ratio of the entire color image formed on one sheet P. This is called the "first printing ratio". Further, "printing ratio" includes the printing ratio for each of the toner colors that are used for forming the color image, and the printing ratio for each of the stripe shaped areas when the color image is divided into a plurality of stripe shaped areas that are parallel to a prescribed axis. The former is called the "second printing ratio" and the latter is called the "third printing ratio".

Although there is only one first printing ratio that is calculated by the calculation section 65, the number of second printing ratio calculated by the calculation section 65 is equal to the number of colors of toners used. Further, the number of the third printing ratio calculated by the calculation section 65 is equal to the number of the plurality of stripe shaped areas that are separated.

Further, it is possible to make combinations of the second printing ratio and the third printing ratio. In other words, the calculation section 65 can also calculate the printing ratio for each of the toner colors that are used for forming the color image for each of the stripe shaped areas when the color image is separated into a plurality of stripe shaped areas that are parallel to a prescribed axis. This is called the "fourth printing ratio", and "printing ratio" includes even this fourth printing ratio.

Hereafter, although the explanations are continued expressing the second printing ratio merely as the "printing ratio", it is of course possible to replace this with the first printing ratio, the third printing ratio, or the fourth printing ratio. In addition, although the explanations are continued taking the printing ratio for the yellow color as an example, apart from this, it is also possible to apply to the magenta color, cyan color, or black color.

The timing control section 66, based on the printing ratio calculated by the calculation section 65, controls the timing at which the exposure section 3Y emits light. The timing at which the exposure section 3Y emits light denotes the timing of the index signal that continuously determines the writing timing in the direction of rotation of the photoreceptor drum (in the sub scanning direction).

The correction table forming section 67 obtains the relationship between the rotation angle of the photoreceptor drum 1Y and the correction amount of the timing at which the exposure section 3Y emits light for a plurality of printing ratios.

Figure 3B:
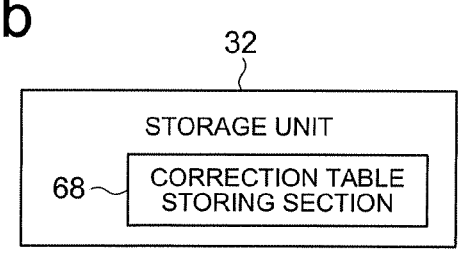
FIG. 3*b* is a block diagram showing the concrete functions carried out by the storage unit 32 of FIG. 2.

The concrete functions carried out by the storage unit 32 of FIG. 2 are explained referring to FIG. 3*b*. The storage unit 32 functions as a correction table storing section 68 that stores a plurality of correction tables LUT that express the relationships described previously that was obtained by the correction table forming section 67. The timing control section 66 refers to the plurality of correction tables LUT stored in the correction table storing section 68, and controls the timing at which the exposure section 3Y emits light.

Next, the concrete control method by the correction table and the timing control section 66 is explained here.

Figure 4:
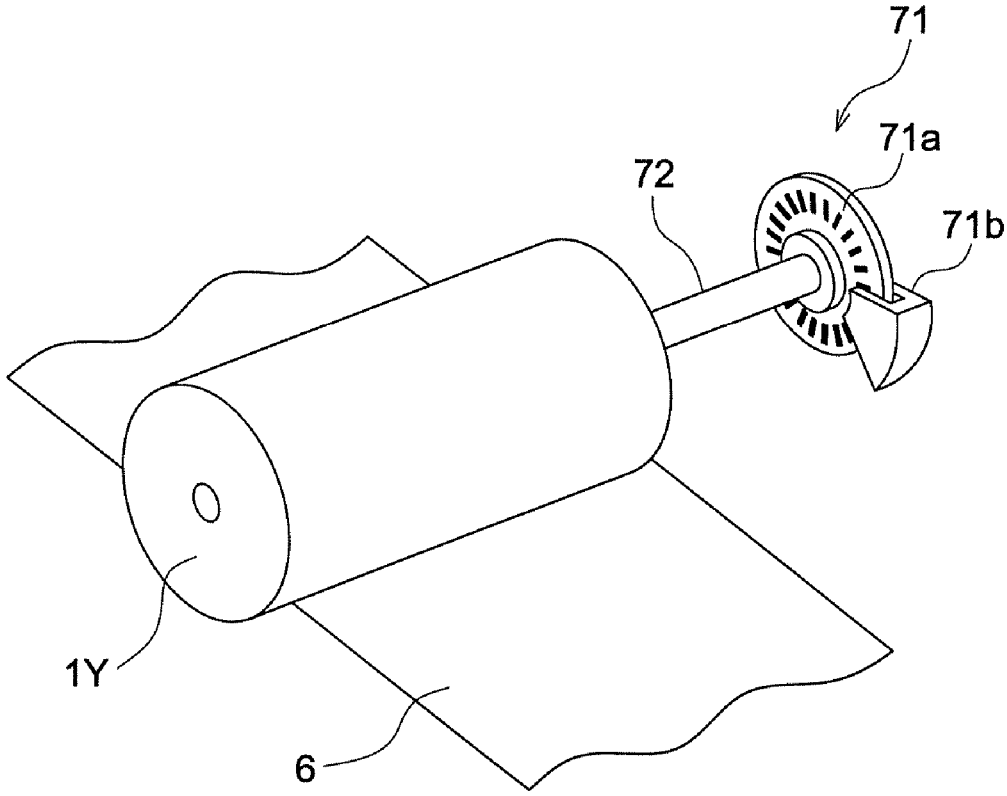
FIG. 4 is a perspective view diagram showing a rotary encoder affixed to a prescribed shaft 72 that is the center of rotation of the photoreceptor drum 1Y.

To begin with, referring to FIG. 4, the rotary encoder 71 that is affixed to the prescribed shaft 72 that becomes the center of rotation for the photoreceptor drum 1Y is explained here. Here, although the explanations are given for the example of the photoreceptor drum 1Y for the yellow color, rotary encoders have been similarly affixed even to the other photoreceptor drums 1M, 1C, and 1K.

The photoreceptor drum 1Y has been fixed to the prescribed shaft 72, and a rotary encoder 71 has been provided to the shaft 72. The rotary encoder 71 has a code wheel 71*a* which is a circular plate in the circumference of which are provided a plurality of slits arranged at uniform intervals, and a detector section 71*b* in which a light source and a light receiving device are placed opposing each other with the code wheel 71*a* between them. The code wheel 71*a* is fixed so that its center is perpendicular to the shaft 72, and the photoreceptor drum 1Y and the shaft 72 both rotate.

In FIG. 4, the timing pulley affixed to the shaft 72, the timing belt wound on the timing pulley, the motor that drives the rotational movement of the timing pulley via the timing belt, and the exposure section 3Y have not been shown in the figure.

In general, due to eccentricity of the timing pulley with respect to the shaft 72, shift of the pitch circular radius of the timing pulley, variations at the time of mating of the tooth groove and tooth, etc., the angular speed of the photoreceptor drum 1Y is not constant, but varies depending on the angle of rotation of the photoreceptor drum 1Y. If the exposing section emits light ignoring these fluctuations in the angular speed, the electrostatic latent image formed by the exposure section 3Y expands in the part where the angular speed is fast, and the electrostatic latent image contracts in the part where the angular speed is slow. By controlling the timing at which the exposure section 3Y emits light according to the variation in this angular speed, it is possible to suppress this kind of shift in the electrostatic latent image.

Further, the angular speed of the photoreceptor drum 1Y also varies depending on the changes in the frictional force between the photoreceptor drum 1Y and the intermediate transfer member 6. This frictional force is related to the quantity of toner used in the formation of color images, and the quantity of toner varies depending on the printing ratio of the color image.

Figure 5A:
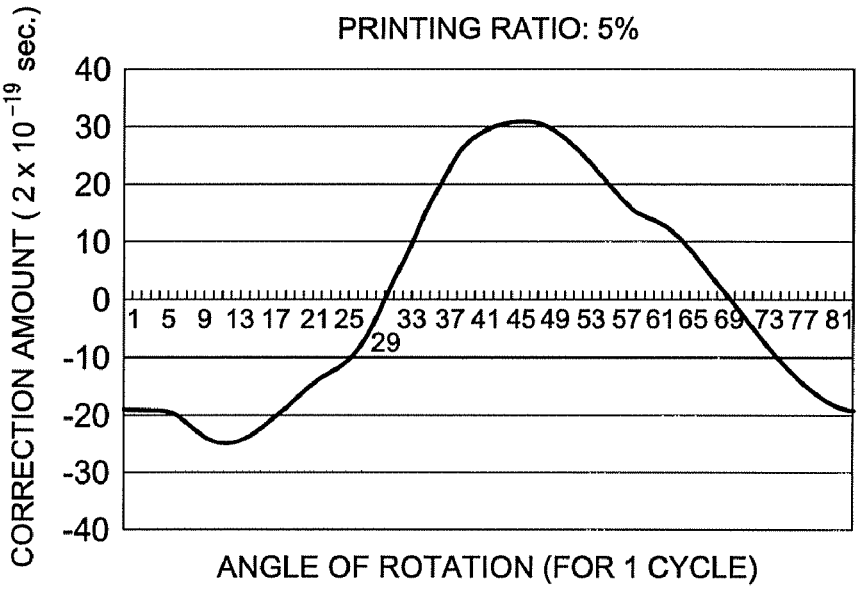
FIG. 5*a* shows the correction table LUT when the printing ratio is 5% and FIG. 5*b* shows the correction table LUT when the printing ratio is 25%.

Therefore, the correction table forming section 67 obtains for a plurality of printing ratios the relationship between the amount of correction of the timing at which the exposure section 3Y emits light and the rotational angle of the photoreceptor drum 1Y. The amount of correction of the timing at which the exposure section 3Y emits light is set according to the amount of variation in the angular speed of the photoreceptor drum 1Y. In concrete terms, the correction table forming section 67 obtains for a plurality of printing ratios the correction tables LUT, for example, such as those shown in FIGS. 5*a* and 5*b*. The unit along the horizontal axis of the correction table LUT corresponds to the rotational angle when one entire circumference of the photoreceptor drum 1Y is divided into 81 equal parts, and the unit along the vertical axis is $2\times10^{-19}$ seconds. FIG. 5*a* shows the correction table LUT for the case when the printing ratio is 5%, and FIG. 5*b* show the correction table LUT for the case when the printing ratio is 25%.

Figure 5B:
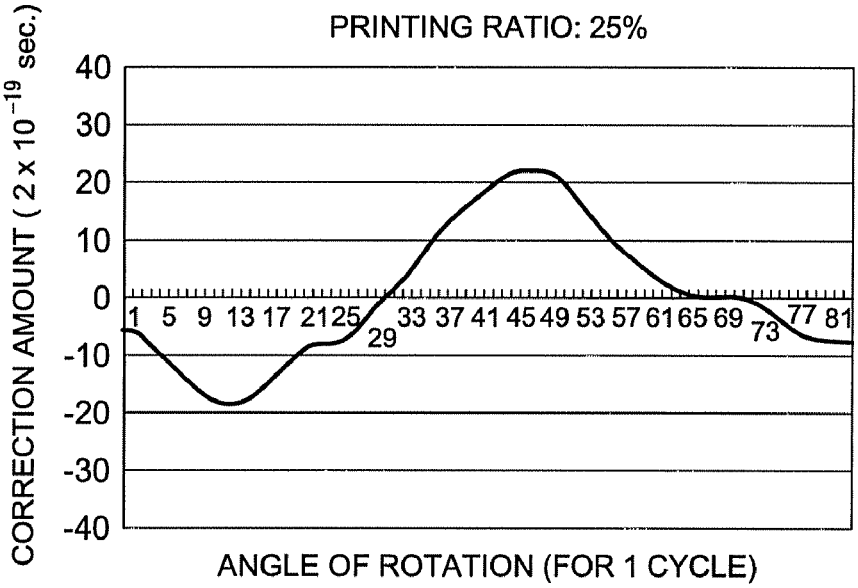

As is shown in FIGS. 5*a* and 5*b*, the amount of correction of the timing at which the exposure section 3Y emits light, that is, the amount of variation of the angular speed of the photoreceptor drum 1Y, is determined by the rotational angle of the photoreceptor drum 1Y, and the absolute value of the amount of correction increases as the printing ratio decreases.

Figure 6:
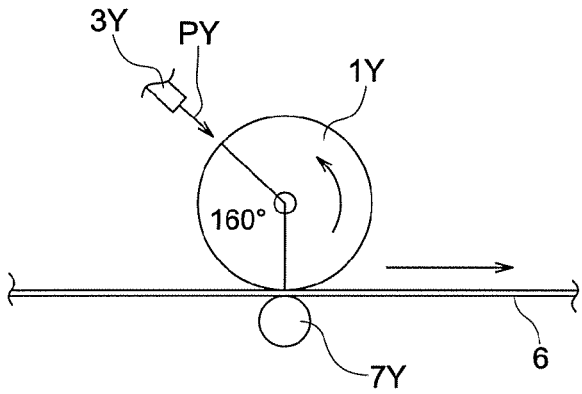
FIG. 6 is a schematic diagram for explaining the method of preparing the correction table when the phase angle between the exposure and primary transfer is 160 degrees.

Here, referring to FIG. 6, the procedure is explained by which the correction table forming section 67 prepares the correction table LUTs shown in FIGS. 5*a* and 5*b*. Using the rotary encoder shown in FIG. 4, the angular speed is measured for one circumference of the photoreceptor drum 1Y. From the measured angular speed, the variation component kw (1 to 360) is obtained, for example, by deducting a constant speed component such as the standard speed, etc. The number in parentheses indicates the rotation angle of the photoreceptor drum 1Y of FIG. 6. Further, the unit of the variation component kw (1 to 360) is the angle of rotation.

As is shown in FIG. 6, since the phase angle is 160 degrees between the position of the photoreceptor drum 1Y to which the exposure section 3Y emits the beam of light PY and the position of transferring the toner image from the photoreceptor drum 1Y to the intermediate transfer member 6, the variation component at the position of transferring to the intermediate transfer member 6 becomes: kw ((161 to 360, 1 to 160)−(1 to 360)). Further, a value obtained by multiplying "−kw ((161 to 360, 1 to 160)−(1 to 360))" by the reference speed is taken as the vertical axis value of FIGS. 5*a* and 5*b*, that is, the amount of correction of the timing at which the exposure section 3Y emits light.

The timing control section 66 carries out control so that the timing at which the exposure section 3Y emits light is shifted by the amount of correction according to the angle of rotation of the photoreceptor drum 1Y as indicated by the correction table LUT.

Figure 7:
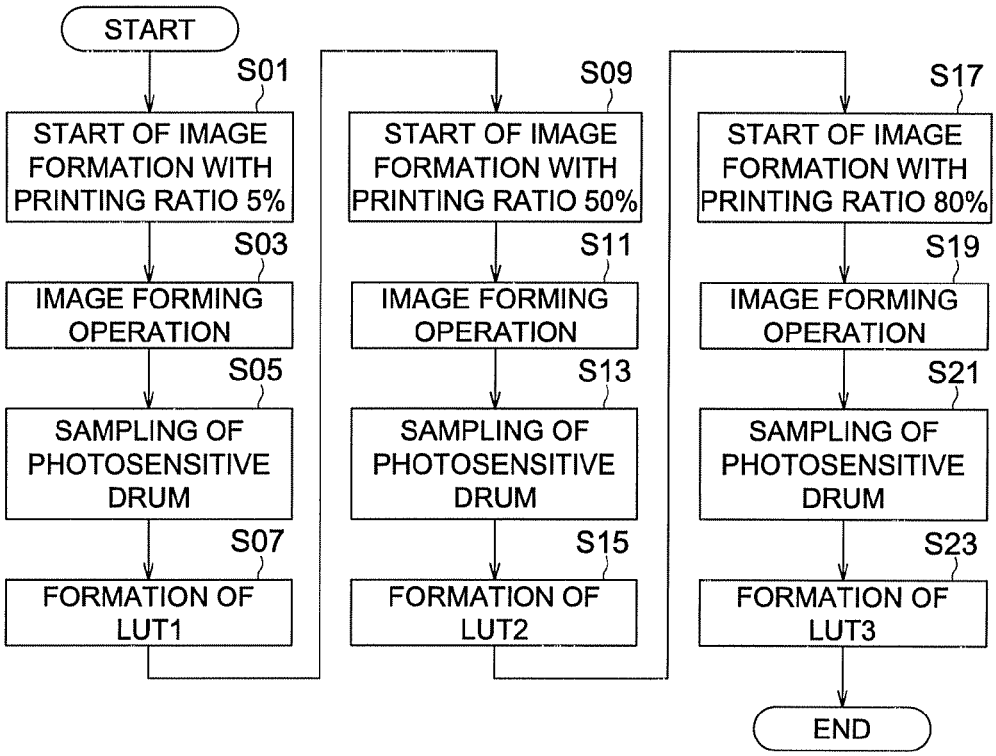
FIG. 7 shows the flow charts showing the procedure of preparing the correction table LUT1 when the printing ratio is 5%, the correction table LUT2 when the printing ratio is 50%, and the correction table LUT3 when the printing ratio is 80%.

Next, referring to FIG. 7, the procedures of preparing the correction table LUT1 for a printing ratio of 5%, the correction table LUT2 for a printing ratio of 50%, and the correction table LUT3 for a printing ratio of 80% are explained here.

In the stage S01, image formation with a printing ratio of 5% is started. Proceeding to stage S03, the sequence of image forming processes explained referring to FIG. 1 are executed, and a color image with a printing ratio of 5% is formed on the sheet P. Proceeding to stage S05, using the rotary encoder 71 shown in FIG. 4, the angular speed of the photoreceptor drum 1Y is measured during the sequence of the image forming processes. Proceeding to stage S07, based on the measured angular speed of the photoreceptor drum 1Y, the correction table forming section 67 prepares the correction table LUT1. The correction table LUT1 so prepared is stored in the correction table storing section 68 of FIG. 3*b*.

Next, proceeding to stage S09, image formation with a printing ratio of 50% is started. Proceeding to stage S11, a color image with a printing ratio of 50% is formed on the sheet P, proceeding to stage S13, using the rotary encoder 71 shown in FIG. 4, the angular speed of the photoreceptor drum 1Y is measured during the sequence of image forming processes. Proceeding to stage S15, based on the measured angular speed of the photoreceptor drum 1Y, the correction table forming section 67 prepares the correction table LUT2. The correction table LUT2 so prepared is stored in the correction table storing section 68 of FIG. 3*b*.

Next, proceeding to stage S17, image formation with a printing ratio of 80% is started. Proceeding to stage S19, a color image with a printing ratio of 80% is formed on the sheet P, proceeding to stage S21, using the rotary encoder 71 shown in FIG. 4, the angular speed of the photoreceptor drum 1Y is measured during the sequence of image forming processes. Proceeding to stage S23, based on the measured angular speed of the photoreceptor drum 1Y, the correction table forming section 67 prepares the correction table LUT3. The correction table LUT3 so prepared is stored in the correction table storing section 68 of FIG. 3*b*.

The timing control section 66, selects, among the plurality of correction tables stored in the correction table storing section 68, the correction table obtained for the printing ratio that is closest to the printing ratio calculated by the calculation section 65. Next, the timing control section 66 refers to the selected correction table, and controls the timing at which the exposure section 3Y emits light.

For example, consider the case in which three correction tables LUT1, LUT2, and LUT3 for printing ratios of 5%, 50%, and 80% have been stored in the correction table storing section 68 according to the flow chart shown in FIG. 7, and the printing ratio calculated by the calculation section 65 is 10%. In this case, since the printing ratio closest among the printing ratios of the three correction tables LUT1, LUT2, and LUT3 is 5%, the timing control section 66 selects the correction table LUT1 for the printing ratio of 5%. Next, the timing control section 66, carries out control so that the timing at which the exposure section 3Y emits light is shifted by the amount of correction according to the angle of rotation of the photoreceptor drum 1Y as indicated by the correction table LUT1. In this manner, the timing control section 66, can refer to the correction table for the most appropriate printing ratio among the plurality of correction tables stored in the correction table storing section 68, and can control the timing at which the exposure section 3Y emits light.

As has been explained so far, according to the present preferred embodiment of the present invention, the following operation effects can be obtained.

The angular speed of the photoreceptor drum 1Y varies according to changes in the frictional force between the photoreceptor drum 1Y and the intermediate transfer member 6. This frictional force is related to the respective toner quantities of the colors yellow, magenta, cyan, and black used for the formation of the color image, and the toner quantities of each of these colors varies according to the respective printing ratios of the colors yellow, magenta, cyan, and black. Therefore, in the preferred embodiment of the present invention, because the calculation section 65 calculates the printing ratios of each of the colors in the color image formed on a sheet, the timing control section 66 controls the timing at which the exposure sections 3Y, 3M, 3C, and 3K emit light on to the cylindrical surfaces of the photoreceptor drums 1Y, 1M, 1C, and 1K based on these printing ratios calculated for each of the colors, it is possible to suppress the color shifts in a direction perpendicular to the shaft 72 of the photoreceptor drums 1Y, 1M, 1C, and 1K that are caused by the variation components in the photoreceptor drums 1Y, 1M, 1C, and 1K according to the printing ratios of the different colors.

If the printing ratio is different for each of the toner colors constituting one color image, the angular speeds of the photoreceptor drums 1Y, 1M, 1C, and 1K vary for each color of toner. Therefore, by controlling the timing at which the exposure sections 3Y, 3M, 3C, and 3K emit light based on the printing ratios for each toner color, the effect of suppressing the color shifts in a direction perpendicular to the shaft 72 of the photoreceptor drums 1Y, 1M, 1C, and 1K increases.

The angular speeds of the photoreceptor drums 1Y, 1M, 1C, and 1K vary periodically based on the angle of rotation of the photoreceptor drums 1Y, 1M, 1C, and 1K. Therefore, the color copying machine 100 is provided with a correction table preparing section 67 that obtains for a plurality of printing ratios the relationship between the angle of rotation of the photoreceptor drums 1Y, 1M, 1C, and 1K and the correction amounts of timings, and a correction table storing section 68 that stores a plurality of correction tables LUT1, LUT2, and LUT3 expressing the relationship obtained by the correction table preparing section 67 for a plurality of printing ratios. Further, the timing control section 66 refers to the plurality of correction tables LUT1, LUT2, and LUT3 stored in the correction table storing section 68, and controls the timings at which the exposure sections 3Y, 3M, 3C, and 3K emit light. The correction tables LUT expressing the relationship between the angle of rotation of the photoreceptor drums 1Y, 1M, 1C, and 1K and the amount of correction of the timings for emitting light by the exposure sections 3Y, 3M, 3C, and 3K are obtained and stored in advance for a plurality of printing ratios, and the timings for emitting light by the exposure sections 3Y, 3M, 3C, and 3K are controlled referring to these correction table LUTs. Because of this, it is possible to suppress the color shifts in a direction perpendicular to the shaft 72 of the photoreceptor drums 1Y, 1M, 1C, and 1K that are caused by the variation components in the photoreceptor drums 1Y, 1M, 1C, and 1K according to the printing ratios of the different colors.

The timing control section 66 selects, among the plurality of correction tables stored in the correction table storing section 68, the correction table LUT obtained for the printing ratio that is closest to the printing ratio calculated by the calculation section 65, refers to the selected correction table, and controls the timings at which the exposure sections 3Y, 3M, 3C, and 3K emit light. Because of this, it is possible to refer to the correction table for the most appropriate printing ratio and to control the timings at which the exposure sections 3Y, 3M, 3C, and 3K emit light.

The timing control section 66 controls the timings at which the exposure sections 3Y, 3M, 3C, and 3K emit light so that the correction amount of the timings at which the exposure sections 3Y, 3M, 3C, and 3K emit light is increased as the printing ratio calculated by the calculation section 65 decreases. As the printing ratio decreases, which being the ratio of the area of image covered by toner in the image area formed on one sheet, the quantity of toner used for forming the color image decrease. And, since the frictional force between the photoreceptor drums 1Y, 1M, 1C, and 1K and the intermediate transfer member 6 increases, the amount of variation in the angular speed of the photoreceptor drums 1Y, 1M, 1C, and 1K becomes larger. Therefore, by increasing the correction amount of the timings at which the exposure sections 3Y, 3M, 3C, and 3K emit light according as the printing ratio calculated by the calculation section 65 decreases, it is possible to suppress the color shifts in a direction perpendicular to the shaft 72 of the photoreceptor drums 1Y, 1M, 1C, and 1K that are caused by the variation components in the photoreceptor drums 1Y, 1M, 1C, and 1K according to the printing ratio.

MODIFIED EXAMPLE

As has been explained earlier, the printing ratio includes the first to the fourth printing ratios, and although in the above preferred embodiment, the explanations were given for printing ratios for each toner color, that is, for the second printing ratio, it is also possible that the printing ratio is the first, third, or the fourth printing ratio. In the modified example, explanations are given for the third printing ratio.

If the printing ratios are different for different stripe shaped areas when one color image is separated into a plurality of stripe shaped areas that are parallel to the prescribed shaft 72, the angular speeds of the photoreceptor drums 1Y, 1M, 1C, and 1K for each stripe shaped area vary for each stripe shaped area. Therefore, in the modified example, the calculation section 65 calculates the printing ratios for each of the stripe shaped areas when the color image is separated into a plurality of stripe shaped areas, that is, the third printing ratios. Next, the timing control section 66 controls the timings at which the exposure sections 3Y, 3M, 3C, and 3K emit light based on the printing ratios for each of the stripe shaped areas calculated by the calculation section 65. Because of this, the effect of suppressing the color shifts in a direction perpendicular to the shaft 72 of the photoreceptor drums 1Y, 1M, 1C, and 1K increases.

Further, instead of calculating the printing ratios for each of the stripe shaped areas when the color image is separated into a plurality of stripe shaped areas parallel to a prescribed axis, it is also possible that the calculation section 65 calculates the printing ratios for two or more neighboring stripe shaped areas. In this case, the timing section 66 controls the timings at which the exposure sections 3Y, 3M, 3C, and 3K emit light based on the printing ratios for the two or more neighboring stripe shaped areas calculated by the calculation section 65.

OTHER PREFERRED EMBODIMENT

As explained above, although the present invention was described using one preferred embodiment and its modified example, the discussions and drawings that form a part of the present disclosure shall not be construed to restrict the present invention. From the present disclosure, various alternative preferred embodiments, examples of implementation, and utilization techniques would be obvious to any person in the field.

Although in the preferred embodiment, the explanations were given for the case in which the timing control section 66 selects the correction table obtained for the printing ratio that is closest to the printing ratio calculated by the calculation section 65 from among the plurality of correction tables LUT1, LUT2, and LUT3 that were stored in the correction table storing section 68, and, referring to the selected correction table, carries out control of the timing at which the exposure section 3Y emits light, the present invention shall not be construed to be limited to this.

Figure 8A:
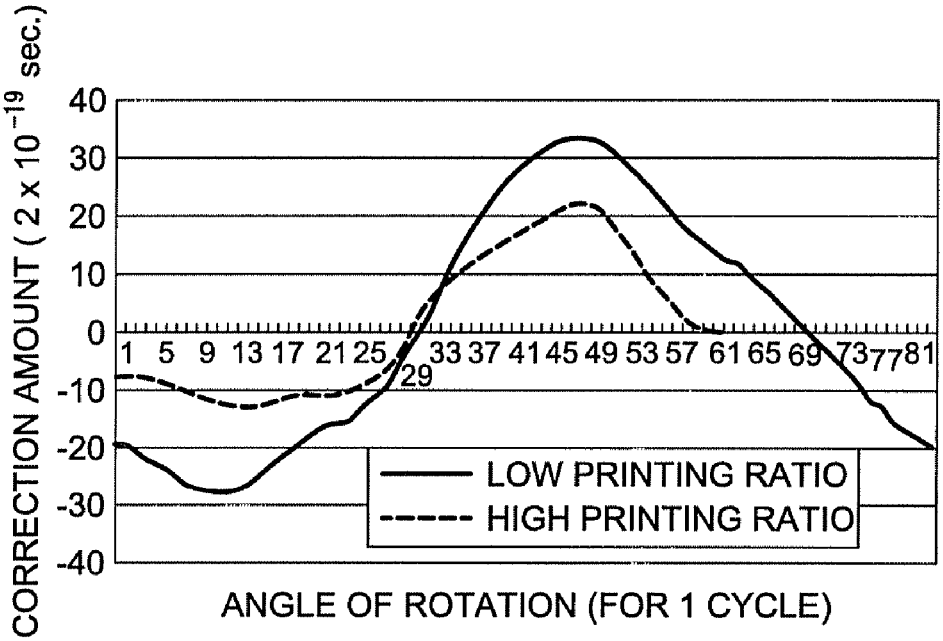
FIG. 8*a* is a graph showing the correction table LUT for a high printing ratio and low printing ratio.
Figure 8B:
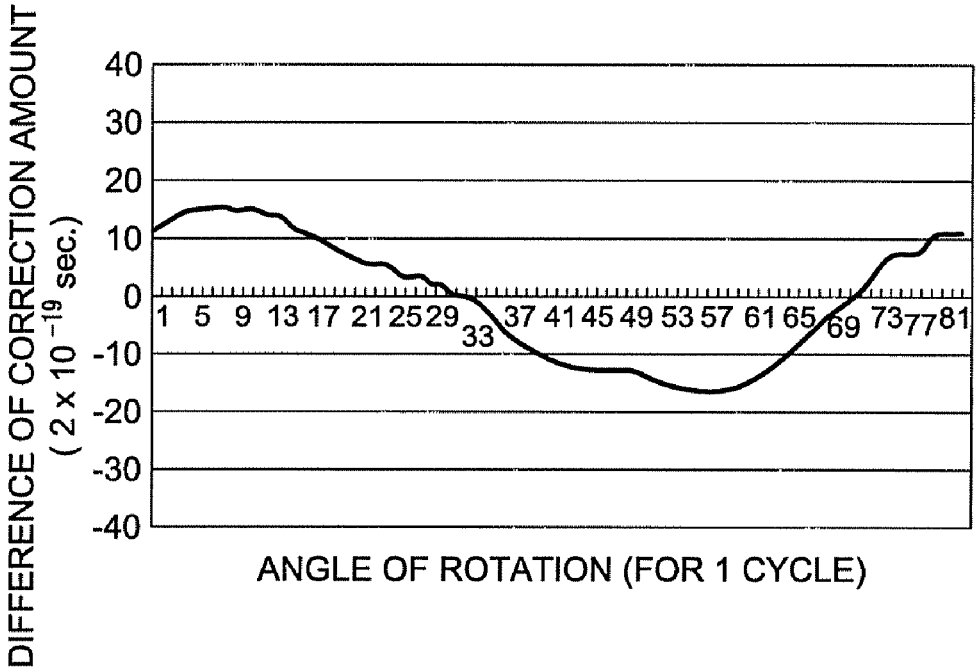
FIG. 8*b* is a graph showing the difference ΔLUT of the correction amounts of FIG. 8*a*.

For example, as is shown in FIGS. 8*a* and 8*b*, the difference ΔLUT is calculated between the correction amounts in the correction table for a high printing ratio and the correction table for a low printing ratio. A multiplication factor is calculated between the difference ΔLUT of the correction amount and the difference of the printing ratio. For example, in the case in which the high printing ratio is 60% and the low printing ratio is 5%, the multiplication factor becomes as follows.

$$LUT/(0.6-0.05)$$

The correction table obtained for the printing ratio that is closest to the printing ratio calculated by the calculation section 65 is selected from the correction table storing section 68, and by multiplying the difference between the printing ratio calculated by the calculation section 65 and the printing ratio of the correction table selected from the correction table storing section 68 with the above multiplication factor, it is possible to execute timing control with a higher accuracy compared to the above described preferred embodiment.

Further, at a predetermined time, the correction table forming section 67 can prepare the correction table LUT by measuring the angular speeds of the photoreceptor drums 1Y, 1M, 1C, and 1K, so that the calculation section 65 can obtain the printing ratio at that time. Further, it is desirable to update the correction tables stored in the correction table storing section 68 with the newly prepared correction table. Further, as an example of the predetermined time, this can be done at the time of correction of the color registration, or at the time of image stabilization control.

In this manner, it is to be understood that the present invention encompasses various forms of implementations that have not been described here. Therefore, the present invention shall only be limited by items specific to the invention that are within the appropriate scope of the claims of the invention from this disclosure.

As described above, the angular speed of the photoreceptor drum varies according to changes in the frictional force between the photoreceptor drum and the intermediate transfer member. This frictional force is related to the quantity of toner used in the formation of color images, and the quantity of toner varies depending on the printing ratio of the color image. Therefore, in a feature of the present invention, since the calculation section calculates the printing ratio of the color image to be formed on one sheet, and based on this calculated printing ratio, the timing control section controls the timing at which the exposure section emits the light towards the cylindrical surface of the photoreceptor drum, it is possible to suppress the color shift in the direction of rotation of the photoreceptor drum that is caused by the variation components of the photoreceptor drum according to the printing ratio.

According to a color image forming apparatus of the present invention, it is possible to suppress color shifts in the direction of rotation of the photoreceptor drums caused by variation components of the photoreceptor drums according to the printing ratios.

What is claimed is:

1. A color image forming apparatus for forming toner images by carrying out charging, exposure, and development on at least one photoreceptor drum, and forming color images by transferring the toner images via an intermediate transfer member onto a sheet, the color image forming apparatus comprising:

a photoreceptor drum which rotates around an axis;

an exposure section which intermittently emits a light beam onto the cylindrical surface of the rotating photoreceptor drum along scanning lines parallel to the axis of the photoreceptor drum;

a calculation section which calculates a printing ratio of a color image to be formed on the sheet, wherein the printing ratio is the ratio of the area to be covered by toner of the color image within a prescribed area on the sheet; and a timing control section which controls a timing at which the exposure section emits the light beam in a direction of rotation of the photoreceptor drum based on the printing ratio calculated by the calculation section, wherein the timing control section increases a correction amount of the timing at which the exposure section emits the light beam as the printing ratio calculated by the calculation section decreases.

2. The color image forming apparatus of claim 1, wherein the printing ratio is a printing ratio for each color of the toner to be used for forming the color image.

3. The color image forming apparatus of claim 1, wherein the printing ratio is a printing ratio for each of stripe shaped areas when the color image is divided into a plurality of stripe shaped areas parallel to the axis of the photoreceptor drum.

4. The color image forming apparatus of claim 1, wherein the printing ratio is each printing ratio for two or more neighboring stripe shaped areas when the color image is divided into a plurality of stripe shaped areas parallel to the axis of the photoreceptor drum.

5. The color image forming apparatus of claim 1, further comprising:

a correction table forming section which obtains, for a plurality of printing ratios, relationship between a correction amount of the timing and a rotational angle of the photoreceptor drum;

a correction table storing section which stores a plurality of correction tables representing the relationship obtained by the correction table forming section for the plurality of printing ratios, wherein the timing control section controls the timing at which the exposure section emits the light beam by referencing the plurality of correction tables stored by the correction table storing section.

6. The color image forming apparatus of claim 5, wherein the timing control section selects a correction table obtained for the printing ratio that is closest to the printing ratio calculated by the calculation section, and controls the timing at which the exposure section emits the light beam based on the selected correction table.

7. The color image forming apparatus of claim 5, wherein the printing ratio is a printing ratio for each color of the toner used for forming the color image.

8. The color image forming apparatus of claim 5, wherein the printing ratio is a printing ratio for each of stripe shaped areas when the color image is divided into a plurality of stripe shaped areas parallel to the axis of the photoreceptor drum.

9. The color image forming apparatus of claim 5, wherein the printing ratio is each printing ratio for two or more neighboring stripe shaped areas when the color image is divided into a plurality of stripe shaped areas parallel to the axis of the photoreceptor drum.

10. The color image forming apparatus of claim 1, wherein the timing control section controls the timing at which the exposure section emits the light beam based on a rotational angle of the photoreceptor drum.

11. A color image forming apparatus for forming toner images by carrying out charging, exposure, and development on at least one photoreceptor drum, and forming color images by transferring the toner images onto sheets, the color image forming apparatus comprising:

a photoreceptor drum which rotates around an axis;

an exposure section which intermittently emits a light beam onto the cylindrical surface of the rotating photoreceptor drum along scanning lines parallel to the axis of the photoreceptor drum;

a calculation section which calculates a printing ratio of a color image to be formed on one sheet, wherein the printing ratio is the ratio of the area covered by toner in the color image;

a timing control section which controls a timing when the exposure section emits the light beam in a direction of rotation of the photoreceptor drum based on the printing ratio calculated by the calculation section;

a correction table forming section which obtains, for a plurality of printing ratios, relationship between a correction amount of the timing and a rotational angle of the photoreceptor drum;

a correction table storing section which stores a plurality of correction tables representing the relationship obtained by the correction table forming section for the plurality of printing ratios;

wherein the timing control section controls the timing when the exposure section emits the light beam by referencing the plurality of correction tables stored by the correction table storing section; and wherein the timing control section controls to increase the correction amount of the timing when the exposure section emits the light beam according as the printing ratio calculated by the calculation section decreases.

12. The color image forming apparatus of claim 11, wherein the printing ratio is a printing ratio for each color of the toner to be used for forming the color image.

13. The color image forming apparatus of claim 11, wherein the timing control section selects a correction table obtained for the printing ratio that is closest to the printing ratio calculated by the calculation section, and controls the timing when the exposure section emits the light beam based on the selected correction table.

* * * * *